US005447251A

United States Patent [19]

Taylor

[11] Patent Number: 5,447,251

[45] Date of Patent: Sep. 5, 1995

[54] VERSATILE COMMERCIAL TRASH BIN LID ASSEMBLY

[76] Inventor: Craig V. Taylor, 8924 Enfield Ave., Northridge, Calif. 91325

[21] Appl. No.: 134,408

[22] Filed: Oct. 8, 1993

[51] Int. Cl.[6] ..... B65D 43/02

[52] U.S. Cl. ..... 220/523; 220/254

[58] Field of Search ..... 232/43.1, 44; 220/909, 220/908, 254, 334, 343, 675, 524, 523, 608, 601, 465; 206/459.5

[56] References Cited

U.S. PATENT DOCUMENTS

| | | | |
|---|---|---|---|
| 3,720,346 | 3/1973 | Cypher . | |
| 3,749,274 | 7/1973 | Mele et al. . | |
| 4,456,141 | 6/1984 | Pamment . | |
| 4,771,940 | 9/1988 | Taylor . | |
| 4,964,523 | 10/1990 | Bieltvedt et al. . | |
| 5,033,520 | 7/1991 | Kuehmichel | 220/254 |
| 5,040,680 | 8/1991 | Wilson et al. | 206/459.5 |
| 5,044,644 | 9/1991 | Duran et al. | 220/908 |
| 5,072,852 | 12/1991 | Smith et al. | 220/524 |
| 5,163,574 | 11/1992 | Sosan | 220/254 |
| 5,165,564 | 11/1992 | Prout et al. . | |
| 5,183,180 | 2/1993 | Hawkins et al. | 220/908 |
| 5,193,708 | 3/1993 | Prout et al. | 220/908 |
| 5,251,775 | 10/1993 | Kruzick et al. | 220/908 |

FOREIGN PATENT DOCUMENTS

| | | | |
|---|---|---|---|
| 1141771 | 12/1962 | Germany | 220/909 |

*Primary Examiner*—Stephen J. Castellano

*Attorney, Agent, or Firm*—Poms, Smith, Lande & Rose

[57] ABSTRACT

A commercial trash bin assembly includes a large commercial trash bin. The commercial trash bin is fitted with a commercial trash bin lid, which has an opening in the front. A user may select from a variety of interchangeable inserts, one of which is mounted onto the lid and received into the opening. One type of insert is fixedly attached to the lid and completely closes the opening. The lid is then used as a standard commercial trash bin lid. Another type of insert is hinged to the lid and is spring-biased into a closed position, but can be opened to insert small objects through the opening without having to lift the full lid. Yet another type of insert provides separate apertures, either for recyclable bottles and cans, for example, or to more evenly distribute the recyclable materials. Arrangements may be provided inside of the commercial trash bin to segregate different recyclable materials.

12 Claims, 5 Drawing Sheets

FIG. 4
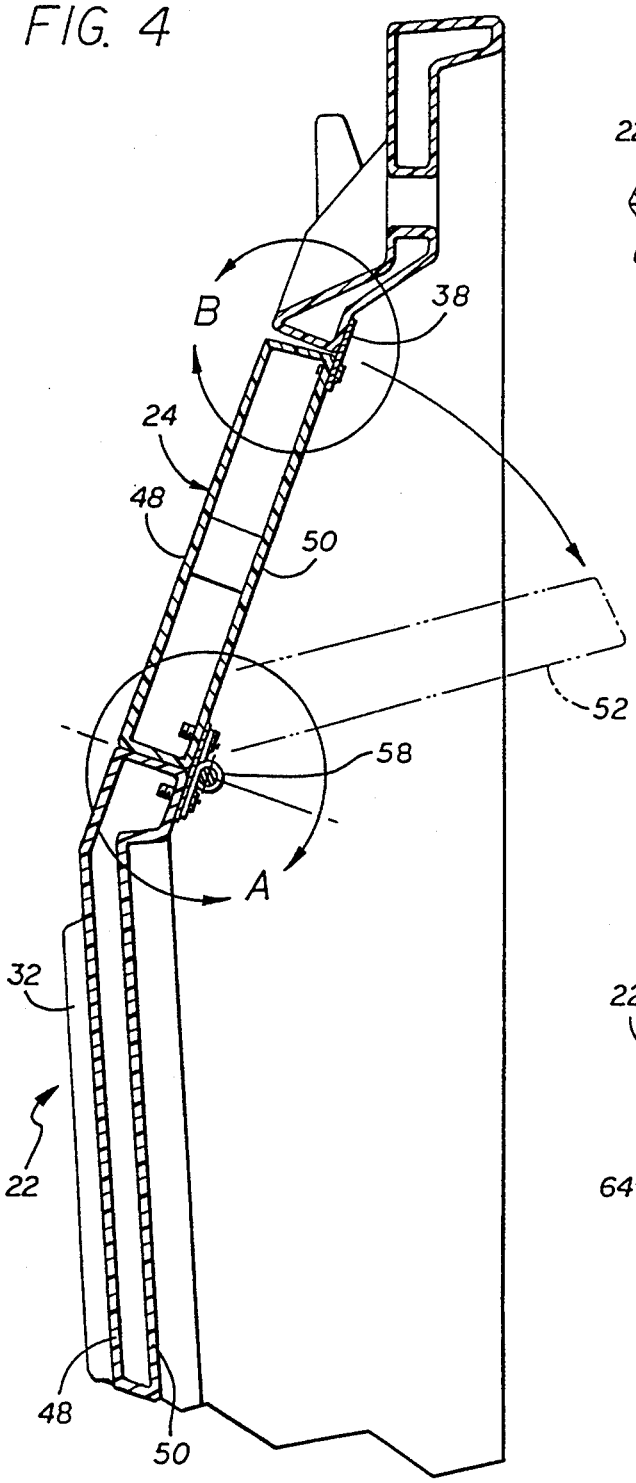
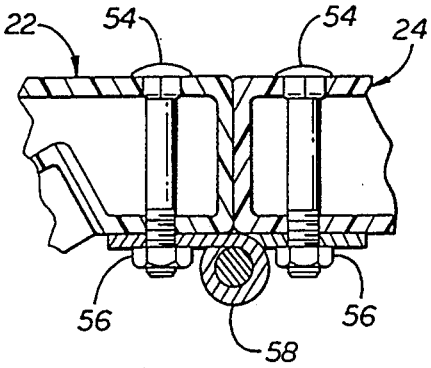
FIG. 4A
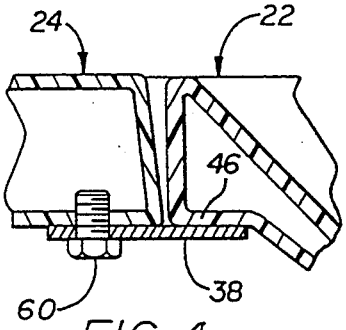
FIG. 4B
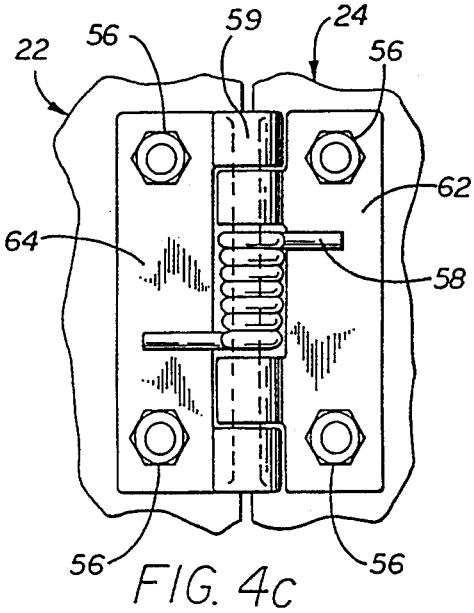
FIG. 4C

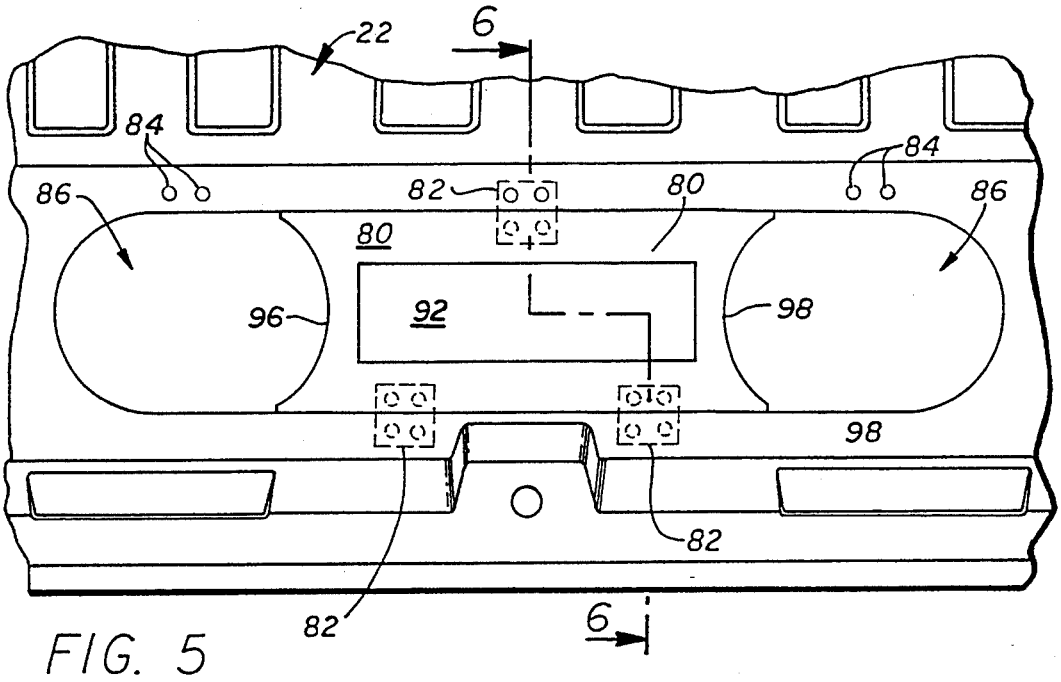
FIG. 5
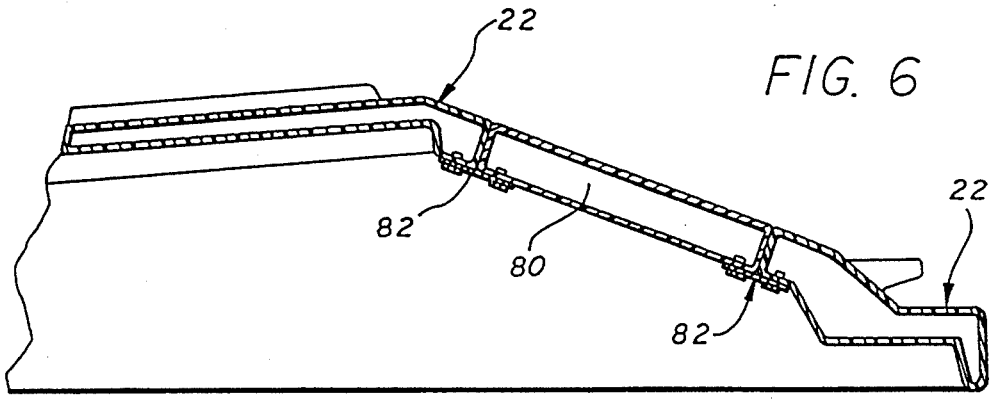
FIG. 6
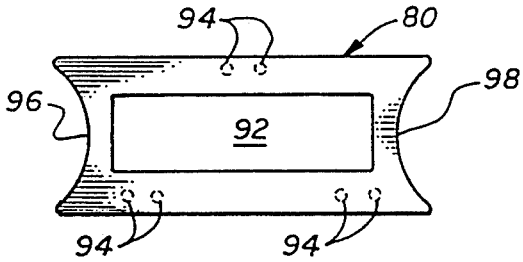
FIG. 7
FIG. 8
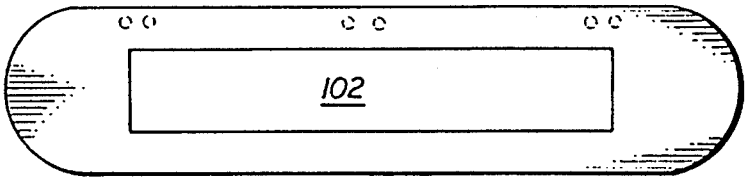

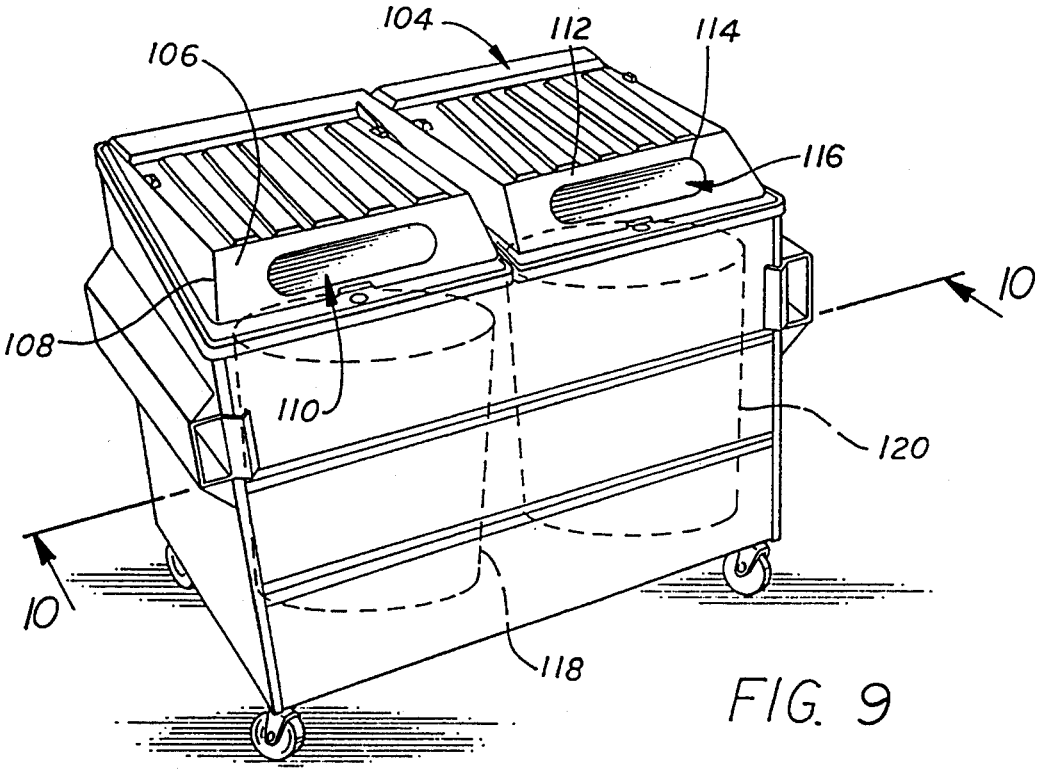
FIG. 9
FIG. 10
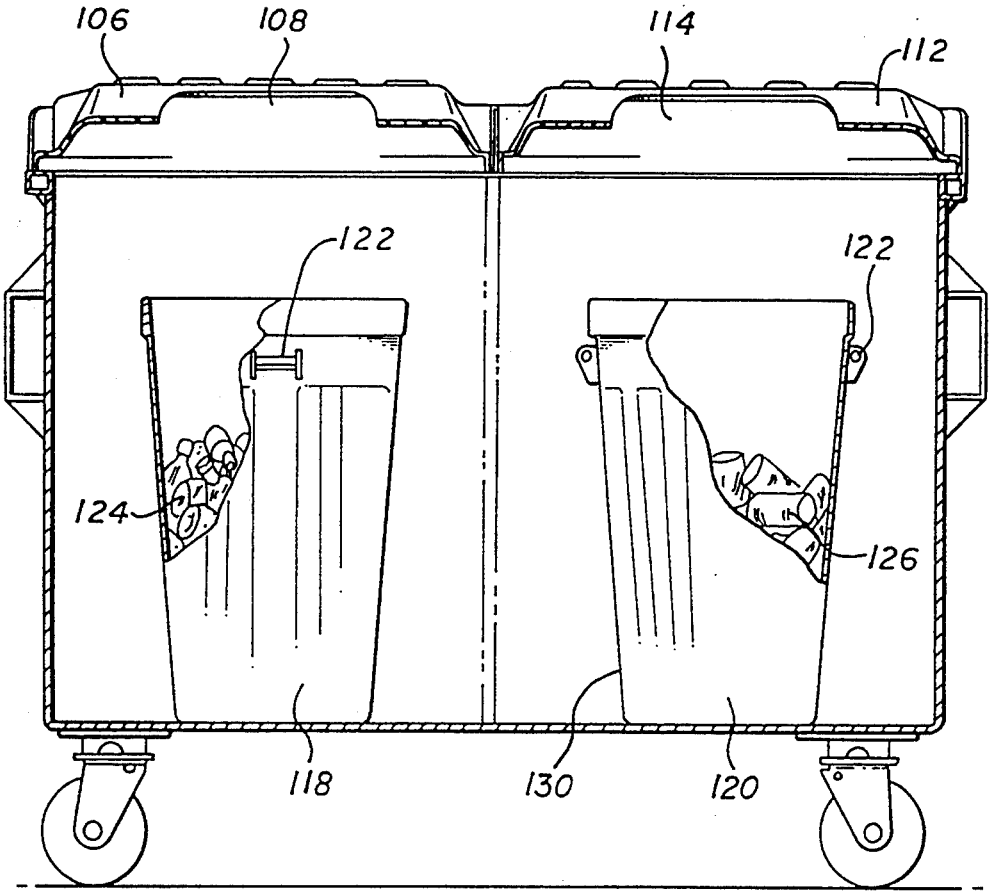

VERSATILE COMMERCIAL TRASH BIN LID ASSEMBLY

FIELD OF THE INVENTION

This invention relates to a versatile trash container lid assembly having interchangeable inserts to easily and inexpensively convert the lid for a variety of different uses.

BACKGROUND OF THE INVENTION

Commercial refuse containers provide storage for substantial quantities of refuse prior to disposal at off-site locations such as landfills or incineration facilities. A typical commercial refuse container is a large, generally rectangular structure with an opening on top. One or more hinged lids swing down to cover the opening, thereby protecting the contents from the elements and preventing garbage odors from escaping.

A variety of commercial trash bin lids have been put into use to accommodate the needs of individual trash bin users. Some lids have been provided with an aperture to allow a user to dispose of small pieces of trash without having to lift the lid. The aperture has sometimes been covered by a small door, such as that disclosed in U.S. Pat. No. 4,456,141, issued to Pamment, which shows an aperture covered by a second lid.

Other lids provide more than one aperture so that a different type of recyclable material can be inserted into each aperture, thereby allowing easy segregation of the different materials. Yet another type of lid provides no open aperture, but does provide a fixed nameplate that displays the name of the owner of the containers.

The need to provide a variety of lids has created a problem for companies that lease commercial trash bin lids. When the lessee returns the bin to the company, the company must change the lid to meet the needs of the next user. So, for example, a county fair might need a fixed-nameplate lid for a few weeks. When the fair is over, the lessor may have to replace the fixed-nameplate lid with a lid having an aperture to meet the needs of an apartment complex that is renting the bin next. The constantly changing needs of the lessees force commercial trash bin lessors to maintain large and expensive inventories of lids. Similarly, an owner of an individual bin may have to pay for a new lid when he or she wants to put the bin to a new use.

SUMMARY OF THE INVENTION

In view of the expense of purchasing and storing various different lids for use on a commercial trash bin, an object of the present invention is to provide a single commercial trash bin lid that can be easily and inexpensively converted to alter the use of the lid. The lid preferably includes as least two different modes. In a first mode, the lid should be provided with a fixed insert which may advertise the name of the owner or user of the lid.

In one or more additional modes, the lid may have an aperture at least partially closed by a plate, which still permits the insertion of trash through the opening. In one alternative mode, a user may swing the plate to open the aperture, so that the user may input a small piece of trash without lifting the lid. In a third mode, the geometry of the plate and the lid may provide two or more openings. A user can then input a different type of recyclable material into each opening. In addition to these different modes, the lid should be easily converted into various modes to accommodate various needs as they arise.

In accordance with illustrative specific preferred embodiments of the invention, a commercial trash bin lid is provided with a standard size opening toward the front thereof. A plurality of mating inserts are provided which may selectively be fitted into the standard size opening to accommodate a variety of uses for the commercial trash bin lid. More specifically, an insert may be: (1) in the form of a fixed insert which may also be a nameplate; (2) a spring biased hinged insert to permit the insertion of newspapers or the like through the hinged insert; or (3) provided with at least two spaced openings to receive different types of trash, such as recyclable cans and bottles.

In accordance with another feature of the invention, the commercial trash bin may have an interior arrangement for separating trash. This arrangement may consist of partitions dividing the commercial trash bin into different regions. Alternately, inner containers may be provided inside the commercial trash bin. With either arrangement, one type of trash is readily separated from other types of trash.

In accordance with one aspect of the invention, a commercial trash bin lid which includes two spaced plastic layers, may be provided with a standard sized opening toward the front of the lid, and the plastic layers may be molded to join each other around the opening to form a high strength smooth opening; and arrangements are provided for securing standard size inserts to fit into the opening.

In accordance with another aspect of the invention, a commercial trash bin lid is provided with a standard size opening toward the front thereof; and alternative mating inserts are provided which may selectively be fitted into the standard size opening to accommodate a variety of uses for the commercial trash bin and lid assembly.

As is readily seen, the present invention satisfies the object of the invention. The interchangeable inserts allow a user to convert the commercial trash bin lid to accommodate a variety of uses. New inserts can be developed to meet the needs of specific users as they arise.

Other objects, features, and advantages of the invention will become apparent from a consideration of the following detailed description and the accompanying drawings.

BRIEF DESCRIPTION OF THE DRAWINGS

FIG. 4 is a cross-sectional view taken along line 4—4 of FIG. 3 showing the swinging motion of the insert, which is mounted to the lid via a hinge and coil spring assembly;

FIG. 4A is an enlarged view of Section A of FIG. 4 showing the coil spring attached to the lid and the insert;

FIG. 4B is an enlarged view of Section B of FIG. 4 showing a stop attached at the lip of the insert to prevent the coil spring from pushing the insert too far open;

FIG. 4C is an enlarged showing of the coil spring and the associated hinge attached to the lid and the insert;

FIG. 5 is a perspective view of an insert mounted onto the lid, the insert being provided with two spaced openings to receive different types of recyclable material, such as bottles and cans;

FIG. 6 is a sectional view taken along line 6—6 of FIG. 5 showing the double-walled construction of the lid and showing that the insert is fixedly attached to the lid;

FIG. 7 is a view of the insert of FIG. 5;

FIG. 8 is a view of an alternative embodiment of a nameplate insert;

FIG. 9 is a perspective view of a commercial trash bin according to the present invention wherein two inner containers are provided for segregating recyclable material from other trash;

FIG. 10 is a cross-sectional view of a commercial trash bin taken along line 10—10 of FIG. 9 showing one inner container storing recyclable glass bottles and another inner container storing recyclable aluminum cans.

DETAILED DESCRIPTION OF THE PREFERRED EMBODIMENTS

Figure 1:
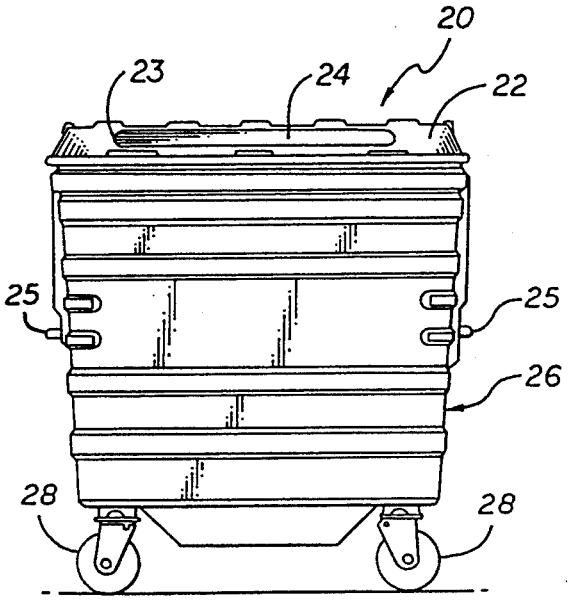
FIG. 1 is a front view of an embodiment of a commercial trash bin assembly in accordance with the present invention.
Figure 2:
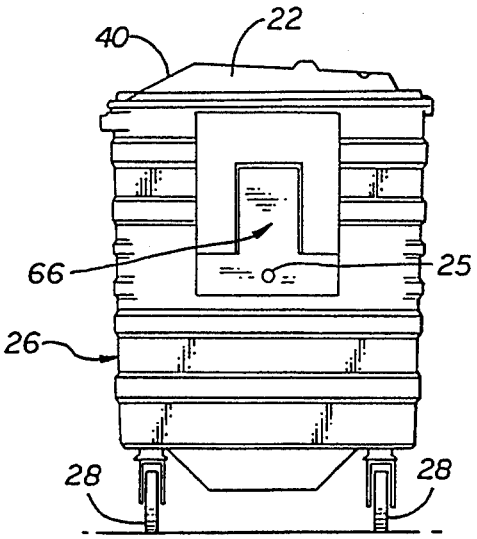
FIG. 2 is a side view of the commercial trash bin assembly of FIG. 1.

Referring more particularly to the drawings, FIG. 1 shows a commercial trash bin assembly 20 according to the present invention. Assembly 20 includes a commercial trash bin lid 22 mounted on a commercial trash bin 26. Lid 22 includes an opening 23 in the front portion of the lid. An insert 24 covers the opening 23. Commercial trash bin 26 is provided with wheels 28 for mobility. FIG. 2 is a side view of the commercial trash bin assembly 20. The commercial trash bin is provided with handle 66, and two outwardly extending pivot pins 25 which allow a mechanized truck to lift the entire commercial trash bin and pivot it about pins 25 to empty its contents. The front portion 40 of lid 22 slopes forward toward the front of the commercial trash bin. As will become apparent, this forward sloping aids the user in disposing of small articles of trash through opening 24.

Figure 3:
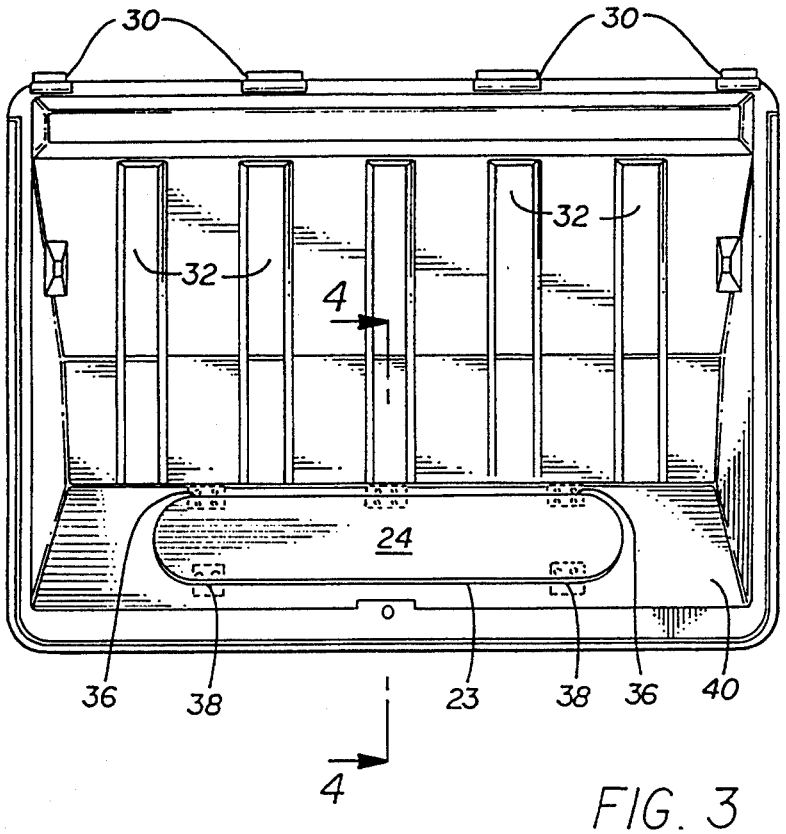
FIG. 3 is a top view of the commercial trash bin lid shown in FIG. 1 showing that the lid is provided with a front opening and an insert hingedly mounted to the lid and covering the front opening.

FIG. 3 shows the commercial trash bin lid 22 in some detail. Ribs 32 stiffen the lid to prevent the lid from sagging. FIG. 9 shows that ribs 32 may be raised above the surface of the commercial trash bin lid. Returning to FIG. 3, hinges 30 attach to a hinge rod (not shown) on the rear of the commercial trash bin, thereby rotatably securing the lid to the commercial trash bin. The front portion 40 of lid 22 is provided with opening 23, which is covered by insert plate 24. Coil spring plates 36 connect insert plate 24 to lid 22. Stop plates 38 prevent insert plate 24 from opening outwardly from the commercial trash bin, but allow the insert plate to open inwardly into the commercial trash bin.

FIG. 4 is a cross-sectional view of the lid assembly taken along line 4—4 of FIG. 3. It is important to note that lid 22 and insert 24 may have a "double-walled" construction. That is, lid 22 and insert 24 have an upper wall 48 and a lower wall 50. This double-wall construction provides additional structural support for the lid. Thus, the lid can be made of a lightweight material, such as a cross-linked polymer, without experiencing sag. This type of double-walled, cross-linked polymer lid is particularly tough and retains its normal shape even after being repeatedly impacted.

FIG. 4 also shows that coil spring 58 in region A spring biases insert 24 into a closed position. Consequently, when the insert plate is rotated clockwise into open position 52, the coil spring will create a force to rotate the insert plate counterclockwise.

FIG. 4A is a close-up, cross-sectional view of Section A in FIG. 4. FIG. 4C is a bottom view of the structure of FIG. 4A. As seen in these figures, spring plate 64 is bolted onto lid 22, and spring plate 62 is bolted onto insert plate 24. Both spring plates are mounted onto shaft 59 so as to allow insert plate 24 to rotate relative to lid 22. Coil spring 58 is mounted onto shaft 59, located between spring plates 62 and 64.

FIG. 4B is a close-up, cross-sectional view of Section B in FIG. 4. Stop plate 38 is bolted onto the edge of insert plate 24. Stop plate 38 extends beyond the edge of insert plate 24 to engage with the front portion of lid 22 when the insert plate is closed. FIG. 3 shows that two short stop plates may be employed, although a third stop plate may be added in between the other two.

FIGS. 5 and 7 illustrate an alternate embodiment of an insert plate 80. The insert plate has curved edges 96 and 98 and is considerably shorter than opening 23. Consequently, apertures 86 are formed at either end of insert plate 80. This allows a user to insert different types of recyclable material in either aperture, or to distribute one recyclable material more evenly to more completely fill the container. For instance, a user might insert glass bottles in one aperture and aluminum cans in the other. A region 92 is provided on insert 80 for imprinting a corporate name and logo or other indicia, as well as the name of the recyclable material to be deposited, or instructions for use. A similar imprint region 102 may be provided on a larger insert nameplate of the type shown in FIG. 8.

Returning to FIG. 5, insert plate 80 is fixedly mounted onto commercial trash bin lid 22. FIG. 6, which is a cross-sectional view taken along line 6—6 of FIG. 5. FIG. 6 shows that insert plate 80 is bolted onto lid 22 so that a user cannot rotatably open the insert plate. Alternately, the insert plate may be mounted onto lid 22 with a coil spring arrangement such as that shown in FIG. 4C.

FIG. 9 illustrates an alternate embodiment 104 of the present commercial trash bin assembly. This embodiment includes two separate lids 106 and 112 having front openings 108 and 114, respectively. This dual-lid arrangement is particularly appropriate for larger commercial trash bins. Inserts 110 and 116 are mounted onto the respective lids by the spring bias arrangement illustrated in FIGS. 4 and 4A–C. Free-standing inner containers 118 and 120 are positioned inside the commercial trash bin, directly behind and below front openings 108 and 114, respectively.

As seen in FIG. 10, a user may insert recyclable materials into openings 108 and 114 for storage in inner containers 118 and 120. FIG. 10 shows that inner container 118 contains glass bottles 124, while inner container 120 contains aluminum cans 126. Handles 122 are provided on containers 118 and 120 to allow a user to lift the containers out of the commercial trash bin to remove the recyclable materials. A mechanized truck can then lift and empty the commercial trash bin in standard fashion.

Dashed lines 130 in FIG. 10 show that the trash container 104 may be partitioned into two compartments, with one type of recyclable material being deposited in one compartment and another type being deposited in the other. The containers may be emptied by mechanized dumpers either using a single truck with a split receiving hopper, or by unlocking one of the lids and then the other as the container is dumped successively by two trucks, one for each type of recyclable material.

The interchangeable inserts that FIGS. 3, 7, and 8 illustrate are a key feature of the present invention. These inserts make the lids of the present invention very versatile. For example, a user may wish to utilize the spaced aperture insert 80 of FIG. 7 to separate recyclable bottles and cans from each other. At a later time, the user can convert the lid for recycling newspapers, for instance, by replacing insert 80 with spring-biased insert 24. At yet another time, the user may replace insert 24 with a nameplate insert that completely covers opening 23 and is fixedly attached to lid 22, thereby creating a standard lid. This versatility spares a user the considerable cost of having to purchase several separate lids. A wide variety of inserts, each having a unique feature can easily be developed to meet specific user needs.

A lid "kit" according to the present invention (FIG. 11) may include a variety of components, such as a lid 22 having a universal access port 23, various insert plates 80, 102 that may be individually mounted within the universal access port, spring hinges 36, plates 82, nuts, bolts, and/or screws 60 of various sizes, and possibly other hardware. When mounted on the lid, inset plate 80 provides two apertures through which recyclable material may be input. The concave end portions of plate 80 provide the apertures.

Figure 11:
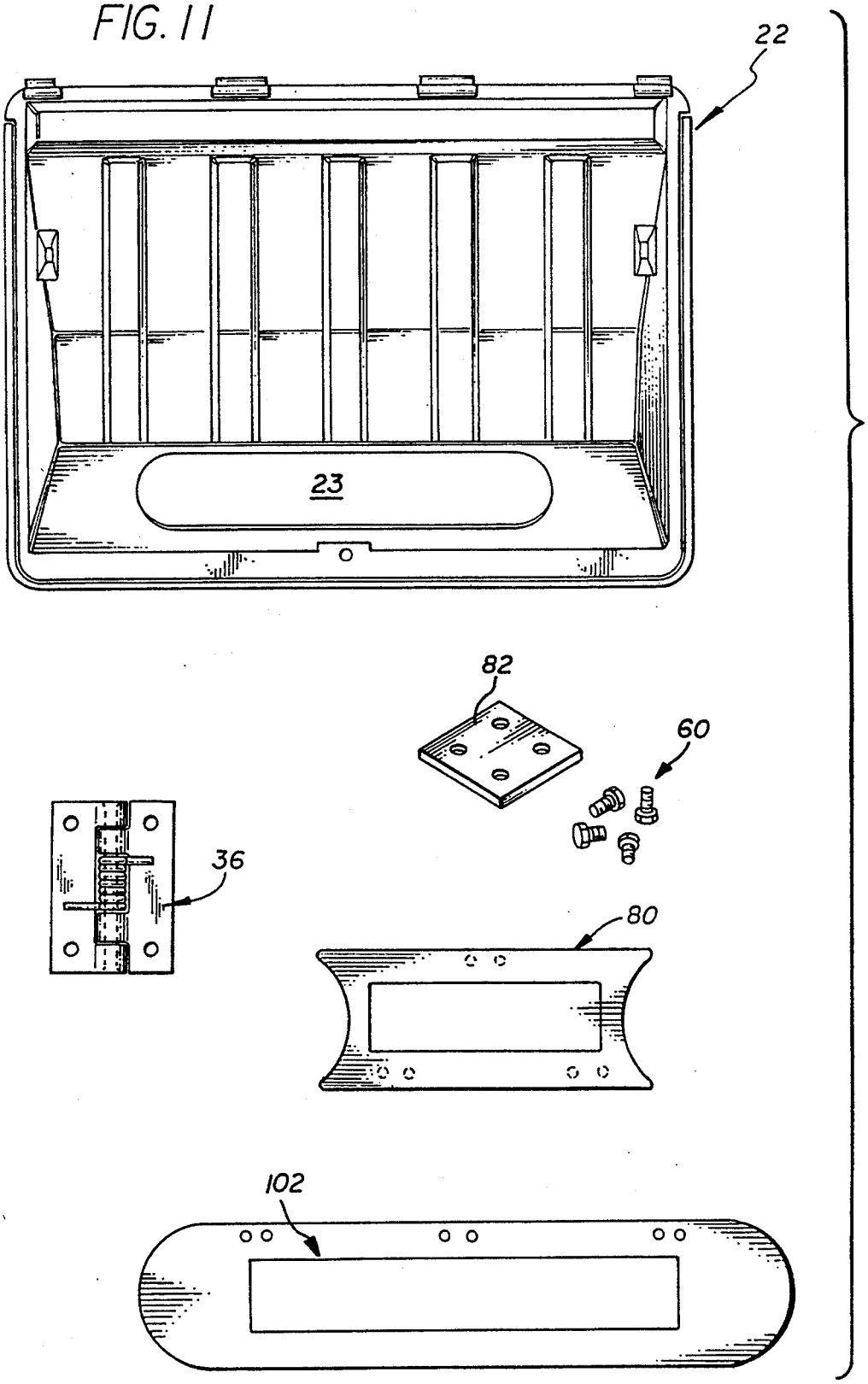
FIG. 11 illustrates the components of a lid kit having a lid for a commercial trash bin container, substantially plate-like inserts and hardware for individually mounting the inserts within the opening in the lid.

A kit such as that shown in FIG. 11 allows the user to configure the lid as she desires. For instance, the user may fixedly mount an insert plate 80 or 102 using a plurality of plates 82 and an appropriate number of screws, nuts and/or bolts 60. Alternatively, the user may hingedly mount an insert plate 80 or 102 with one or more spring hinges 36 and an appropriate number of screws or nuts and bolts. Various other components may be added to the kit, depending on the needs of the user.

In the preferred embodiment, the refuse container cover of this invention is manufactured from an organic polymer such as a polyethylene resin which is cross-linked and manufactured using conventional rotational molding techniques. Among the materials available are cross-linked HDPE compounds of polyethylene resins as manufactured by the Phillips Chemical Company of Bartlesville, Okla. under the registered trademark Marlex. Similar suitable materials are available from the PAXON company. Preferable, a cross-linked polyethylene material is used to manufacture the cover of this invention. A variety of polyethylenes may be used including linear low-density polyethylites. The nature of the organic polymer is preferably such that it has thermal setting characteristics. However, included within the materials which may be used to manufacture the cover of this invention are thermoplastic materials such as vinyl, polyethylene, and polypropylene.

The refuse container lids are preferably formed by a rotational molding process. Rotational molding is known per se, and involves closing two metal mold halves and clamping these together. Heat is applied to the mold at a controlled temperature, while the mold is rotated simultaneously about two axes, with powdered plastic particles within the mold. The tumbling plastic particles melt and gradually fuse to form a homogenous layer of substantially uniform thickness over the entire inner surface of the mold. A hollow article having a substantially continuous outer surface is thus formed. The refuse container lids could be formed by other techniques, such as by forming the upper and lower surfaces separately, and bonding them together along their peripheries by blow molding or any other hollow part molding process; however, the rotational molding, or roto-molding process is preferred.

It may also be noted that the lids may have a raised upper surface, and a mating recessed lower surface so that the lids may be stacked in a nested or interfitting manner. To give the general idea of dimensions, a typical commercial trash bin lid as used in the United Kingdom may be 1235 mm wide by 920 mm deep by 27 mm thick. An insert of the type illustrated in FIG. 8 may be 750 mm wide by 148 mm deep by 27 mm thick. The rounded edges of the removable plate may be portions of circles having radii of 74 mm. A typical commercial trash bin may be 1370 mm high by 1275 mm wide by 980 mm deep. The approximate minimum commercial trash bin volume for the present invention is about 500 liters. Incidentally, a typical small commercial trash bin of the type widely used in the U.S. and as shown in FIGS. 9 and 10, may be about six feet long and three feet from front to back. It should be stressed, however, that specific dimensions vary widely depending on the particular embodiment and on the particular country for which it is intended.

While a particular preferred embodiment has been disclosed, it will be understood that variations and modifications may be effected without departing from the spirit and scope of the invention. Thus, by way of example and not of limitation, lid 22 may have a single-layer construction using aluminum, steel or other metal. Additionally, a wide variety of plastics known to those skilled in the art may be used rather than cross-linked polymers. A commercial trash bin may be provided with three or more lids rather than the one or two illustrated in the drawings. Compartments may be built into the commercial trash bin to separate the recyclable materials and trash, rather than removable inner containers. The commercial trash bin need not be rectangular, but may be circular or any other shape, and is not limited to any particular dimension. The lids may have several openings rather than just one, and the openings may be located anywhere on the lid. Brushes or rubber flaps may be provided in apertures 86 (FIG. 5) to discourage pilfering.

Accordingly, the present invention is not limited to the specific embodiment shown in the drawings and described in the detailed description.

What is claimed is:

1. A commercial trash bin assembly comprising:

a commercial trash bin;

a double-walled plastic commercial trash bin lid covering an open top of the bin and having a front portion and an opening in the front portion, said opening having dimensions of at least twelve inches by at least two inches, said lid comprising two spaced layers of material, said layers being molded to join each other around said opening to form a smooth, high-strength perimeter; and a plurality of interchangeable, substantially plate-like inserts, each separately mountable within said lid opening, said assembly further including at least a first insert which is adapted to completely close said lid opening, and a second insert which is adapted to only partially close said lid opening, and said second insert being adapted to form at least one aperture within the periphery of said lid opening when mounted on said lid.

2. A commercial trash bin assembly as defined in claim 1, wherein said commercial trash bin has a minimum volume of at least 500 liters.

3. A commercial trash bin lid assembly comprising:

a commercial trash bin lid having a front portion, the commercial trash bin lid having an opening in the front portion;

said lid having an extent of at least three feet in at least one direction, and a plurality of interchangeable inserts of different configurations, each insert consisting of a substantially planar plate of material, each of which is adapted to be individually fitted to said lid to be received into and at least partially close said opening.

4. A commercial trash bin lid assembly as defined in claim 3, wherein said assembly further comprises spring hinge means for attaching one of said inserts to said commercial trash bin lid to comprise a mounted insert, said spring hinge means allowing said mounted insert to swing open so that a user may input refuse through the opening in the commercial trash bin lid, said spring hinge means biasing said mounted insert back into a closed position.

5. A commercial trash bin lid assembly as defined in claim 3, wherein at least one of said inserts is adapted, when mounted on said lid, to provide an aperture to receive refuse.

6. A commercial trash bin lid assembly as defined in claim 5, wherein said aperture is provided with means to discourage pilfering through said aperture.

7. A commercial trash bin lid assembly comprising:

a commercial trash bin lid having a front portion, the commercial trash bin lid having an opening in the front portion;

said lid having an extent of at least three feet in at least one direction;

a plurality of interchangeable inserts of different configurations, each of which is adapted to be individually fitted to said lid to be received into and at least partially close said opening; and wherein at least one of said inserts is adapted, when mounted on said lid, to provide a plurality of spaced apertures to receive different types of recyclable material or to distribute it more evenly.

8. A commercial trash bin lid assembly as defined in claim 3, wherein at least one of said inserts is adapted to fully close said opening and wherein said assembly includes arrangements for fixedly securing said insert to said lid so that said opening remains closed during normal use of said lid.

9. A commercial trash bin lid assembly as defined in claim 3, wherein at least one of said inserts includes a removable nameplate having indicia printed thereon.

10. A commercial trash bin lid assembly as defined in claim 3, wherein said commercial trash bin lid further comprises two spaced layers.

11. A commercial trash bin lid assembly as defined in claim 10, wherein said layers are molded to join each other around said opening to form a smooth, high-strength perimeter.

12. A commercial trash bin lid assembly as defined in claim 3, wherein at least one of said inserts comprises a nameplate insert, wherein said assembly includes means for fixedly mounting the nameplate insert in said opening, and wherein at least one other insert constitutes means for permitting the deposit of trash through said opening.

* * * * *